United States Patent [19]

Pontier

[11] Patent Number: 4,582,279

[45] Date of Patent: Apr. 15, 1986

[54] MODULATION SYSTEM FOR RAILWAY TRACK CIRCUITS

[75] Inventor: Claude Pontier, Velizy Villacoublay, France

[73] Assignee: Alsthom-Atlantique, Paris, France

[21] Appl. No.: 570,339

[22] Filed: Jan. 13, 1984

[30] Foreign Application Priority Data

Jan. 13, 1983 [FR] France ..... 83 00429

[51] Int. Cl.[4] ..... B61L 21/00

[52] U.S. Cl. ..... 246/34 B; 246/122 R; 328/120; 340/825.64; 340/933

[58] Field of Search ..... 246/34 R, 34 A, 34 B, 246/34 CT, 122 R, 220; 340/933, 825.68, 825.64; 328/120; 371/55, 65; 375/104

[56] References Cited

U.S. PATENT DOCUMENTS

| | | | |
|---|---|---|---|
| 2,515,868 | 7/1950 | Gilson | 246/34 R |
| 3,399,351 | 8/1968 | Reszka | 328/120 X |
| 3,562,712 | 2/1971 | Thorne-Booth et al. | 340/825.68 |
| 3,757,112 | 9/1973 | Lehman | 246/122 R |
| 3,902,161 | 8/1975 | Kiowski et al. | 340/825.68 X |
| 3,958,781 | 5/1976 | Woods et al. | 246/34 R |
| 4,320,881 | 3/1982 | Campbell | 246/34 B |

FOREIGN PATENT DOCUMENTS 1349651 4/1974 United Kingdom .

*Primary Examiner*—Robert B. Reeves
*Assistant Examiner*—Edward M. Wacyra
*Attorney, Agent, or Firm*—Sughrue, Mion, Zinn, Macpeak, and Seas

[57] ABSTRACT

A modulation system for railway track circuits in which a modulated signal is applied to a section of track for the purpose of detecting the presence or absence of a train on the section. Such circuits are used to control signalling and they are vital to safe operation of a railway. At a transmitter end, the output (19) of a power amplifier (18) is connected to a section of track. The power amplifier (18) receives the modulated signal from a modulator (17) which is itself controlled by a pseudorandom binary sequence generator comprising a clock (11), a shift register (10), and a modulo 2 adding circuit (13, 14, 15). Equivalent circuitry is used at a receiver end to recognize the pseudorandom sequence in the absence of a train on a given section of track. The likelihood of interference from a train on that section generating an interference signal capable of being mistakenly recognized for the absence of a train can be reduced to an arbitrarily low value.

9 Claims, 2 Drawing Figures

MODULATION SYSTEM FOR RAILWAY TRACK CIRCUITS

The present invention relates to a modulation system for railway track circuits.

BACKGROUND OF THE INVENTION

In operation, track circuit apparatus is often subjected to interference from currents of large amplitude. The present invention enables the probability of error due to such interference to be reduced to an arbitrarily low value.

In railway technology, track circuit apparatus is widely used, and has been in use for a long time, to indicate the absence of a train on a given section of track. The principle of track circuits to divide a railway track into successive sections which are electrically isolated from one another by pairs of isolating joints that ensure electrical discontinuity in each of the two rails. An electrical signal transmitter is connected to the two rails at one end of such a section, and a receiver for receiving said signals after they have travelled through said rails is connected to the same two rails, but at the other end of the section. A train entering the section at the receiver end shortcircuits the signals via its wheels and axles, and this electrical short circuit is detected by the receiver which causes the signalling to change state, eg. by changing a green light to a red light at the beginning of the section, thereby preventing a following train from entering the section. The receiver also detects when the first train leaves the section, and again causes the signalling to change state.

Track circuits generally use either pulse type modulation, or a sinusoidal carrier frequency in conjunction with amplitude or frequency modulation. With pulse type modulation, the track transmitter of a given section applies pulses of one polarity and at a specific recurrence frequency to the track, while the transmitters of the adjacent sections apply pulses of opposite polarity and slightly different recurrence frequency. When a modulated carrier frequency is used, both the carrier frequency and the modulation frequency differ between adjacent sections. With both types of modulation (ie. pulse or carrier), the "train" or "no train" state of the receiver is a function of the amplitude of the signal it detects at the appropriate frequencies and/or polarity for its own section. Thus, with pulse modulation, the receiver switches to a "train"state whenever it detects a missing pulse, a pulse of the wrong polarity, or a pulse of too low amplitude, while with carrier modulation, the receiver switches to the "train" state whenever it detects a loss of carrier, a carrier at too low amplitude, or modulation at the wrong frequency.

Unfortunately, such conventional track circuit modulation systems are not reliable enough to guarantee safety. The ever increasing power of modern traction motors and of auxiliary equipment such as various types of converters (eg. current, voltage, or frequency converters) is giving rise to ever increasing levels of interference currents of ever more complex waveforms. Further, the modulation characteristics of conventional systems are fixed and unchangeable once the system is installed. It is thus clear that an interference signal in the frequency band used by a track circuit and having a waveform similar to that of the signals used is capable of causing a receiver to switch into the "no train present" state, with possible disasterous consequences.

Preferred modulation systems in accordance with the present invention greatly reduce the possibility of this happening. A high level of safety is provided in which the probability of mistaken signal identification is insignificant.

SUMMARY OF THE INVENTION

The present invention provides a modulation system for railway track circuits in which a modulated signal is applied to a section of track for the purpose of detecting the presence or absence of a train on said section, the improvement wherein said modulated signal comprises a binary sequence of one value signal elements and of zero value signal elements, and wherein said modulation system includes means for generating a pseudorandom sequence of bits for determining said binary sequence.

Different pseudorandom sequences are advantageously used in successive sections of track.

Such a system requires a transmitter for the modulated signal, and a preferred transmitter includes a cyclic code generator for generating said pseudorandom sequence and constituted by: a clock signal generator; a shift register connected to be clocked by said clock signal and having n stages, a serial input, a serial output, and a plurality of parallel outputs from at least some of said stages; and a modulo 2 adding circuit including at least one exclusive-OR gate, said modulo 2 adding circuit having its inputs connected to a selection of said parallel outputs from said shift register and having a modulo 2 sum output connected to said serial input, successive bits of said pseudorandom sequence appearing at said serial output during successive periods of said clock signal.

The transmitter may further include a pulse generator capable of delivering pulses of opposite polarity, and a power amplifier connected to amplify pulses from said pulse generator and to apply said amplified pulses to a section of railway track, said pulse generator having a control input connected to said serial output from said shift register to receive said pseudorandom binary sequence, and responding thereto by delivering pulses of a first polarity whenever a one value signal is present at said serial output and by delivering pulses of opposite polarity whenever a zero value signal is present.

Alternatively, the transmitter may further include a modulator capable of modulating a carrier frequency, and a power amplifier connected to amplify modulated carrier frequency and to apply said amplified modulated carrier frequency to a section of railway track, said modulator having a control input connected to said serial output from said shift register to receive said pseudorandom binary sequence, and responding thereto by modulating said carrier with a first frequency whenever a one value signal is present at said serial output and with a different frequency whenever a zero value signal is present.

The modulator may be an amplitude modulator or a frequency modulator.

Such a system also requires a receiver for receiving the modulated signal after it has passed along the tracks, and a preferred receiver includes a demodulator for demodulating the received signal; a cyclic code generator for generating a copy of said pseudorandom sequence and constituted by: a clock signal generator for generating a clock signal in synchronism with the received signal; a shift register connected to be clocked by said clock signal and having n stages, a serial input, and a plurality of parallel outputs from at least some of said stages; a modulo 2 adding circuit including at least one exclusive-OR gate; and a comparator; said serial input being connected to receive said received signal after demodulation, said modulo 2 adding circuit having its inputs connected to a selection of said parallel outputs from said shift register and having a modulo 2 sum output connected to one input of said comparator, and said comparator having another input connected to receive said demodulated received signal, the presence of different signals at said inputs to said comparator being indicative of the presence of a train on the associated section of track.

Advantageously, the receiver further includes a delay circuit connected to the output from said comparator to ensure that the presence of identical signals at said inputs to said comparator is not taken to be indicative of the absence of a train from said section of track until identical signals have been present for a sufficient number of successive clock cycles to reduce the probability of error to a desired value.

BRIEF DESCRIPTION OF THE DRAWING

An embodiment of the invention is described, by way of example with reference to the accompanying drawing, in which.

MORE DETAILED DESCRIPTION

Figure 1:
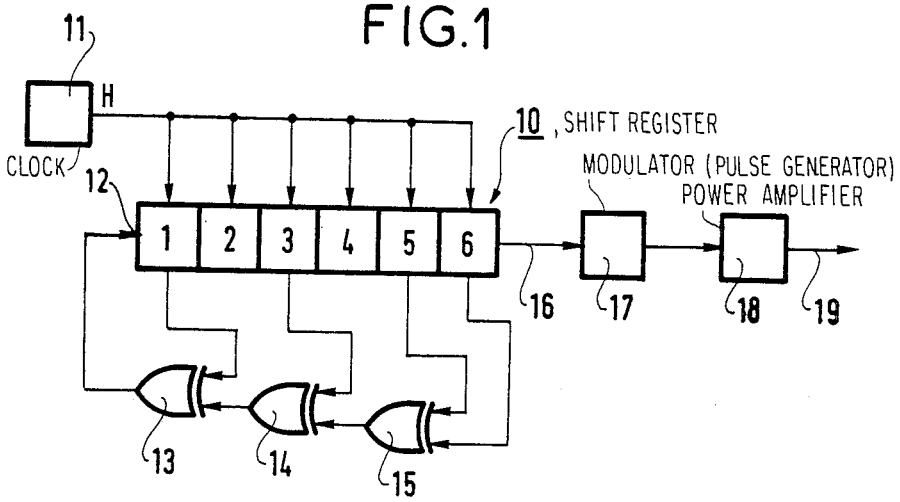
FIG. 1 is a block diagram of a track circuit transmitter modulated by means of a pseudorandom binary sequence generator.

FIG. 1 shows a track circuit transmitter including an n stage shift register 10, where n equals six, for example. The shift register 10 has a serial input 12, a serial output 16 and parallel outputs from each of its stages 1 to 6. It is clocked by a clock 11. The bit applied to the serial input 12 at each clock pulse is obtained by modulo 2 addition performed by three exclusive-OR gates 13, 14, and 15 connected, in the present example, to add together the bits present in stages 1, 3, 5 and 6. Thus, at each clock pulse, the serial output 16 provides a different bit of a pseudorandom sequence in the course of generation. Different transmitters use different connections to the various stages for modulo 2 addition in order to ensure that they generate different pseudorandom sequences, but the last stage 6 is always used in order to take full advantage of the length of the shift register 10.

Provided suitable combinations of bits are chosen for modulo 2 addition, such a circuit including an n bit shift register will generate a linear periodic binary sequence of length $2^{n-1}$ bits. Polynomial theory can be used to show that if the n bits present in the shift register at each instant are considered to be an n-bit number, then all possible n-bit numbers other than 0 . . . 0 are generated once and once only in each complete cycle of the generator. The order in which the n-bit numbers are generated is a function of the specific bits included in the modulo 2 addition. Thus, given a knowledge of the number of stages n in the shift register, the specific configuration of bits used for the modulo 2 addition, and the number contained in the register at a given instant, it is possible to calculate the successive future states of the register, and thus the pseudorandom sequence which will be generated thereby.

The serial output 16 is connected to a modulator or pulse generator 17 which applies a signal to a power amplifier 18 having an output 19 for applying an amplified modulated or pulse signal to the track.

If the block 17 is a modulator, the signal applied to the track will have a carrier frequency of about 1000 Hz, for example, and the carrier will be amplitude or frequency modulated using a modulation frequency F1 of, say, 12 Hz to represent the presence of a one bit at the output 16, and a modulation frequency F0 of, say, 17 Hz to represent a zero bit at the output 16.

If the block 17 is a pulse generator, the signal applied to the track may comprise positive going rectangular pulses when a one bit is present at the output 16 and negative going rectangular pulses when a zero bit is present at the output 16.

The modulated signal is amplified by the amplifier 18 to the level required for proper operation of the track circuit and is injected into one end of a section of track in which the absence of a train is to be detected via the amplifier output 19.

Figure 2:
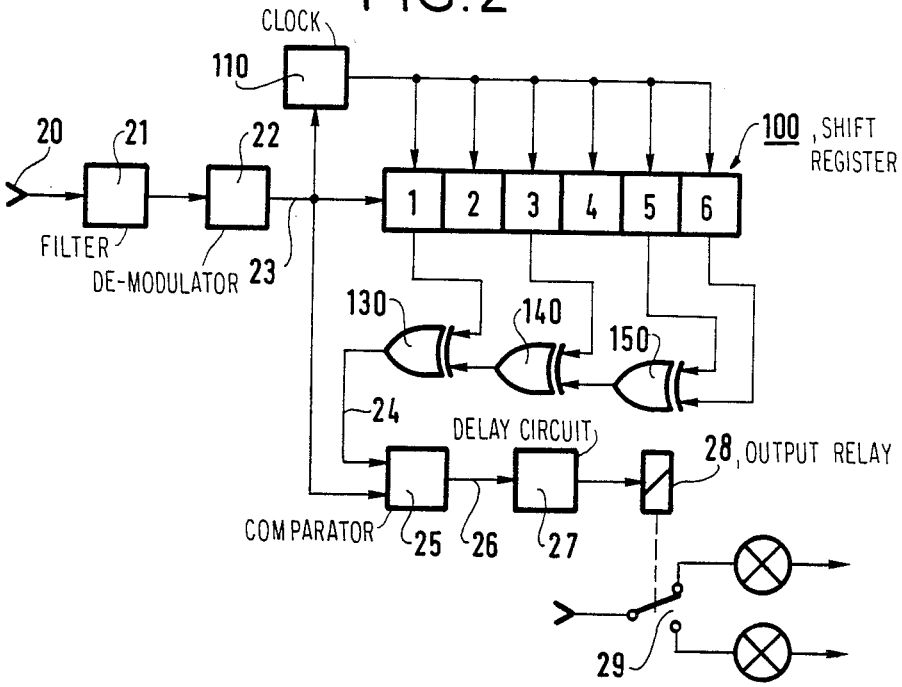
FIG. 2 is a block diagram of a track circuit receiver for receiving signals that have passed along the track and which are encoded by means of a pseudorandom binary sequence.

FIG. 2 shows a track circuit receiver corresponding to the transmitter shown in FIG. 1.

The receiver has an input 20 connected to the track at the opposite end of the section to which the transmitter is connected. The signal present at the input 20 is initially filtered by a filter 21. If a pulse modulation system is being used, the filter is matched to the recurrence frequency and to the width of the pulses being used, and if a carrier modulation system is being used, the filter 21 is a bandpass filter centered on the frequency.

A demodulator 22 then demodulates the filtered signal. The demodulator comprises active components, eg. diodes.

The binary sequence generated at the output 16 of the transmitter shift register 10 is thus reconstituted at the output 23 of the demodulator. The reconstituted binary sequence is applied to the serial input of a shift register 100 having the same length as the transmitter shift register 10. The shift register 100 is clocked by a clock 110 which synchronized on the signals present at the output 23 from the demodulator 22. The receiver shift register 100 is associated with a chain of exclusive-OR gates 130, 140, 150 which are connected to perform modulo 2 addition on the same configuration of bits in the receiver shift register 100 as is used in the transmitter shift register 10, ie. to parallel outputs from stages 1, 3, 5 and 6 in the present example.

Polynominal theory can be used to show that after a synchronization period of duration at most equal to n bits (where n is the number of shift register stages), the bit present at the output 24 from the modulo 2 adding chain in the receiver will be equal to the bit received at the output 23 of the demodulator 22 during the following period of the transmitter clock 11. This equality is monitored by a comparator 25 which provides a one signal at its output 26 whenever two one bits or two zero bits are simultaneously applied to its inputs. When different bits are applied to its inputs, it applies a zero bit to its output 26 indicating that the comparison has failed.

The output 26 from the comparator 25 is applied to a delay circuit 27 which controls an output relay 28 having contacts 29 for controlling the lamps of a signal at the entrance to the section of track in question. The delay circuit 27 passes a failed comparison directly, but it prevents equality from becoming effective until it has existed for m successive comparisons. Worst case calculations show that when m=32 and n=6, the probability of the receiver providing mistaken identification of the received pseudorandom sequence is acceptably low. Other values of m, n and the clock frequency could be used to obtain any desired probability of error.

The present invention is applicable to railway transport systems, and in particular to signalling safety.

I claim:

1. A modulation system for railway track circuits in which a modulated signal is applied to a section of track for the purpose of detecting the presence or absence of a train on said section, the improvement wherein said modulated signal comprises a binary sequence of one value signal elements and of zero value signal elements, and wherein said modulation system includes means for generating a pseudorandom sequence of bits for determining said binary sequence.

2. A system according to claim 1, wherein different pseudorandom sequences are used in successive sections of track.

3. A system according to claim 1, including a transmitter of said modulated signal, wherein said transmitter includes a cyclic code generator for generating said pseudorandom sequence and constituted by: a clock signal generator; a shift register connected to be clocked by said clock signal and having n stages, a serial input, a serial output, and a plurality of parallel outputs from at least some of said stages; and a modulo 2 adding circuit including at least one exclusive-OR gate, said modulo 2 adding circuit having its inputs connected to a selection of said parallel outputs from said shift register and having the modulo 2 sum output connected to said serial input, successive bits of said pseudorandom sequence appearing at said serial output during successive periods of said clock signal.

4. A system according to claim 3, wherein said transmitter further includes a pulse generator capable of delivering pulses of opposite polarity, and a power amplifier connected to said pulse generator to amplify pulses from said pulse generator and to apply said amplified pulses to a section of railway track, said pulse generator having a control input connected to said serial output from said shift register to receive said pseudorandom binary sequence, and responding thereto by delivering pulses of a first polarity whenever a one value signal is present at said serial output and by delivering pulses of opposite polarity whenever a zero value signal is present.

5. A system according to claim 3, wherein said transmitter further includes a modulator capable of modulating a carrier frequency, and a power amplifier connected to said modulator to amplify modulated carrier frequency and to apply said amplified modulated carrier frequency to a section of railway track, said modulator having a control input connected to said serial output from said shift register to receive said pseudorandom binary sequence, and responding thereto by modulating said carrier with a first frequency whenever a one value signal is present at said serial output and with a different frequency whenever a zero value signal is present.

6. A system according to claim 5, wherein said modulator is an amplitude modulator.

7. A system according to claim 5, wherein said modulator is a frequency modulator.

8. A system according to claim 1, further including a receiver for receiving said modulated signal after it has passed along a section of railway track, wherein said receiver includes a demodulator for demodulating the received signal; a cyclic code generator for generating a copy of said pseudorandom sequence and constituted by: a clock signal generator for generating a clock signal in synchronism with the received signal; a shift register connected to be clocked by said clock signal and having n stages, a serial input, and a plurality of parallel outputs from at least some of said stages; a modulo 2 adding circuit including at least one exclusive-OR gate; and a comparator; said serial input being connected to receive said received signal after demodulation, said modulo 2 adding circuit having its inputs connected to a selection of said parallel outputs from said shift register and having the modulo 2 sum output connected to one input of said comparator, and said comparator having another input connected to receive said demodulated received signal, the presence of different signals at said inputs to said comparator being indicative of the presence of a train on the associated section of track.

9. A system according to claim 8, wherein said receiver further includes a delay circuit connected to the output from said comparator to ensure that the presence of identical signals at said inputs to said comparator is not taken to be indicative of the absence of a train from said section of track until identical signals have been present for a sufficient number of successive clock cycles to reduce the probability of error to a desired value.

* * * * *